US008028792B2

(12) United States Patent
Arai

(10) Patent No.: US 8,028,792 B2
(45) Date of Patent: Oct. 4, 2011

(54) SPEAKER APPARATUS

(75) Inventor: Akira Arai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/410,917

(22) Filed: Mar. 25, 2009

(65) Prior Publication Data

US 2009/0260915 A1 Oct. 22, 2009

(30) Foreign Application Priority Data

Mar. 27, 2008 (JP) ..... 2008-085212

(51) Int. Cl.
*H04R 1/28* (2006.01)

(52) U.S. Cl. ..... 181/156; 381/349

(58) Field of Classification Search ..... 181/148, 181/152, 156, 199, 192, 195; 381/345, 349, 381/352

See application file for complete search history.

(56) References Cited

U.S. PATENT DOCUMENTS

| | | | | |
|---|---|---|---|---|
| 5,892,183 | A * | 4/1999 | Roozen et al. | 181/156 |
| 7,184,566 | B2 * | 2/2007 | Tamura et al. | 381/388 |
| 2005/0039975 | A1 * | 2/2005 | Sadaie et al. | 181/192 |

FOREIGN PATENT DOCUMENTS

| | | |
|---|---|---|
| JP | A-10-028298 | 1/1998 |
| JP | 2008-48176 A | 2/2008 |

OTHER PUBLICATIONS

Office Action in JP 2009-069640 dated Jun. 21, 2011.

* cited by examiner

*Primary Examiner* — Jeremy Luks
(74) *Attorney, Agent, or Firm* — Crowell & Moring LLP

(57) ABSTRACT

A speaker apparatus according to the present invention includes a phase inversion-type enclosure in which a speaker unit and a bass reflex port are installed, the bass reflex port having a tubular body whose hollow cross-sectional area gradually becomes smaller from one opening side toward an inside of the bass reflex port in an axial direction of the bass reflex port, and a length in one direction of the hollow cross section of the tubular body not changing and constant along the axial direction.

3 Claims, 11 Drawing Sheets

SPEAKER APPARATUS

BACKGROUND OF THE INVENTION

1. Field of the Invention

The present invention relates to a speaker apparatus that is provided with a bass reflex structure.

Priority is claimed on Japanese Patent Application No. 2008-082512, filed Mar. 27, 2008, the content of which is incorporated herein by reference.

2. Description of Related Art

As a speaker apparatus that performs bass enhancement disclosed in Japanese Unexamined Patent Application, First Publication No. 2008-48176, a phase inversion-type enclosure is used. A phase inversion-type enclosure includes a speaker unit that is installed in a baffle plate that serves as a front panel of the cabinet, and a bass reflex port. The bass reflex port has an opening portion that is formed in the front panel of the cabinet and a cylindrical portion that is installed inside of the enclosure and connected to this opening portion.

A structure of a bass reflex port has been prepared to solve various issues.

For example, when the diameter of the bass reflex port is constant and an edge portion (angle portion) is at the end surface of its opening end, noise is produced by the generation of a vortex at the angle portion during air intake. In order to solve this issue, a structure is generally used that adds roundness in a radial shape to the angle of the opening ends 101', 102' of the bass reflex port 10' as shown in FIG. 10. FIG. 10 shows the various structures of a general phase inversion-type enclosure 2' in a conventional small-diameter speaker 1'.

The bass reflex port enhances the bass by employing the Helmholtz resonance that occurs due to an air spring inside of an enclosure and the air mass in the bass reflex port. Accordingly, the set frequency of the bass to be boosted is determined by the relationship between the shape of the cabinet 11' that forms the enclosure 2' and the shape of the bass reflex port 10'. For this reason, the inner diameter of the bass reflex portion 10' may become small depending on the shape of the cabinet 11'.

When the inner diameter of the bass reflex portion 10' becomes small, the flow velocity of air in the bass reflex port 10' speeds up, and the discharge flow velocity from the port also speeds up. For this reason, in the case of a grill or punching metal being installed at the opening portion, the discharge air from the port collides with the grill or the like, producing noise. In order to solve this issue, for example, a shock absorbing material or the like is installed that suppresses the flow velocity of air in the bass reflex port.

However, in the case of using a structure that adds roundness in a radial shape to the angle of the opening ends a bass reflex port having a structure that extends the opening end three dimensionally and in a radial shape, since the linearity of the discharge air flow is strong, when being discharged, the air, while dispersing gradually, flows nearly straight ahead along the central axis of the bass reflex port, and is discharged with its flow velocity mostly maintained. Accordingly, if a grill is installed as described above, noise is produced. Moreover, the same phenomenon also occurs at the opening end on the side of the speaker unit. That is, noise is produced inside the enclosure by the air that is discharged from this opening end colliding with the speaker unit or an inner wall of the enclosure.

Also, in the case of a shock absorbing material being installed in the bass reflex port, the effect of bass enhancement diminishes since braking caused by air resistance from the shock absorbing material acts on the above-mentioned resonance action. The diminishing of the bass enhancement effect becomes prominent when the inner diameter of the bass reflex port must be narrowed to increase the flow velocity in order to make the enclosure compact.

Furthermore, when it is necessary to make a bend midway in the bass reflex port in order to increase the length of the bass reflex port, if the flow velocity of the bass reflex port is fast, the bend portion must be made into a shape that curves as gradually as possible. Accordingly, in this case structural restrictions are significantly incurred.

SUMMARY OF THE INVENTION

An object of the present invention is to achieve a speaker apparatus with a simple structure that solves the various issues resulting from air being drawn and discharged by the bass reflex port.

A speaker apparatus according to the present invention includes a phase inversion-type enclosure in which a speaker unit and a bass reflex port are installed, the bass reflex port having a tubular body whose hollow cross-sectional area gradually becomes smaller from one opening side toward an inside of the bass reflex port in an axial direction of the bass reflex port, and a length in one direction of the hollow cross section of the tubular body not changing and constant along the axial direction.

In this constitution, the bass reflex port is formed so that the hollow cross sectional area increases along the axial direction from the inside of the bass reflex port toward one opening end. In one embodiment, for example, by the formation of a closed region by a first wall pair that has a constant interval and a second wall pair that gradually comes apart, the bass reflex port is formed as a tubular body in which the hollow cross-sectional area gradually increases without changing the length in one direction of the hollow cross section in the axial direction.

In this structure, during air intake, the air intake cross-sectional area at the opening side of the tubular body is large compared to the hollow cross-sectional area at the inside of the bass reflex port. For this reason, the flow velocity of the intake air that is drawn into the tubular body decreases, and turbulence at the opening end of the tubular body is suppressed. Moreover, in one embodiment, since the walls of the tubular body are of a constant or gradually changing shape as given above, angular portions do not exist in the walls and turbulence does not occur even if the flow velocity of the air increases toward the connecting end side of the tubular bodies.

Meanwhile, in one embodiment, during air discharge, due to the first wall pair, diffusion of air in the direction of this wall pair is suppressed, and so a constant pressure continues to act in this direction from the first wall pair to the air in the hollow portion. In this way, a pressure continues to act from the direction of the first wall pair, and an air flow is produced that spreads through the entire cross section. While this state is maintained, due to the cross section of the hollow portion gradually increasing as the interval of the second wall pair widens, the discharge air flow velocity gradually decreases. Thereby, during air discharge, the flow velocity of discharged air that is discharged from the tubular body portion is reduced.

Also, the speaker apparatus according to the present invention may be provided with a main tubular portion and an air rectifier that connects to at least one end of the main tubular portion. The main tubular portion may be a predetermined length portion of the tubular body portion along the axial direction at a location at which the hollow cross-sectional area is smallest, and the hollow cross-sectional area may be constant. The air rectifier may be a portion of the tubular body portion in which the hollow cross-sectional area gradually increases from the side that connects to the main tubular portion toward the opening end of the bass reflex port, and a length in one direction of the hollow cross-sectional area is a constant dimension.

This constitution is not limited to a structure in which air rectifiers are installed at both ends of the main tubular portion as stated above, and even for a structure in which the air rectifier is installed at only one end of the main tubular portion, at the side in which the air rectifier portion is installed, the above-mentioned action during air intake and the action during air discharge are obtained.

Also, in the speaker apparatus according to present invention, the main tubular portion and the air rectifier may be arranged so that a center of the hollow cross section of the main tubular portion that is perpendicular to the axial direction and a center of the hollow cross section of the air rectifier that is perpendicular to the axial direction agree. Moreover, walls of connecting portions of the main tubular portion and the air rectifier may have a shape that smoothly connect walls of the main tubular portion and walls of the air rectifier.

In this constitution, since the structure of the connection portion of the main tubular portion and the air rectifier is simplified, and discontinuous surfaces are not formed, turbulent resistance against the flow of air between the main tubular portion and the air rectifier is suppressed.

Also, in the air rectifier of the speaker apparatus according to the present invention, from a location where the hollow cross-sectional area is the smallest toward a bass reflex port opening end, the hollow cross-sectional area may have a shape that is set by an exponential function value corresponding to the distance from the location at which the hollow cross-sectional area in the axial direction is the smallest.

In this constitution, as a specific method of determining the hollow cross-sectional area, area setting in accordance with an exponential function value is performed. With this setting, the opposing two walls that constitute the second wall pair have a shape in which the interval always spreads out along the long direction (axial direction) of the bass reflex port. Moreover, there is no sudden change in the interval, and the interval smoothly widens. With this constitution, the above-mentioned turbulence suppression action during air intake and the discharge air flow velocity reduction action during air discharge are more effectively obtained.

Also, in the speaker apparatus according to the present invention, the phase inversion-type enclosure may further comprise a cabinet having a rectangular shape that is long in a long direction thereof; the speaker unit may be arranged at one end in the long direction of the cabinet; an opening portion of the bass reflex port may be arranged at an other end in the long direction; and the air rectifier may be arranged along the long direction.

In this constitution, as a specific enclosure structure a rectangular cabinet is adopted, and the speaker unit, bass reflex port, and bass reflex port opening portion are arranged in this long direction. In this structure, since the bass reflex port has the discharge air flow velocity reduction action described above, even if the inner opening portion of the bass reflex port is brought near the speaker unit, or an external structural element such as a grill or punching metal is brought near the bass reflex port opening portion, the generation of noise by the discharged air from the bass reflex port acting on the speaker unit or external structure is suppressed. That is, even if the speaker apparatus is made compact by arranging the constituent elements of the enclosure at optimal locations while bringing them closer in accordance with the shape of the cabinet, noise is not produced.

Also, in the speaker apparatus according to the present invention, the opening portion at the bass reflex port opening portion is arranged in a direction different from the long direction.

In this constitution, at the bass reflex port opening portion, an opening portion may be arranged at one side other than the long direction, and walls are arranged at the other four sides. In this structure as well, since the bass reflex port has the discharge air flow velocity reduction action mentioned above, even in the case of a wall being brought close to the bass reflex port opening portion in the long direction, noise that is generated by discharged air from the bass reflex port acting on the wall is suppressed, and even if the opening portion is arranged facing a direction different than the long direction, noise is not generated. Moreover, even if an external structural element such as a grill or punching metal is brought near the opening portion, the generation of noise by the discharged air from the bass reflex port acting on the speaker unit or external structure is suppressed.

That is, even if the speaker apparatus is made compact by choosing any direction for the opening of the bass reflex port while bringing the constituent elements of the enclosure closer together in accordance with the shape of the cabinet, noise is not generated.

According to this invention, since turbulence is suppressed when the bass reflex port is in the air intake state, it is possible to effectively control the generation of noise in the air intake state. Moreover, since the air discharge flow velocity is reduced when the bass reflex port is in the air discharge state, it is possible to also effectively suppress noise that is generated by the discharged air colliding with members outside the bass reflex port. Thereby, it is possible to achieve a speaker apparatus that suppresses the generation of noise while effectively enhancing the bass.

Moreover, since this speaker apparatus exhibits greater effect the faster the flow velocity in the bass reflex port is, it is possible to more effectively suppress the generation of noise in a compact speaker apparatus in which increasing the flow velocity of the bass reflex port is unavoidable for structural reasons.

BRIEF DESCRIPTION OF THE DRAWINGS

FIG. 9 B is a side view showing the speaker apparatus shown in FIG. 8.

DETAILED DESCRIPTION OF THE INVENTION

The speaker apparatus according to an embodiment of the present invention shall be described with reference to the appended drawings.

Figure 1:
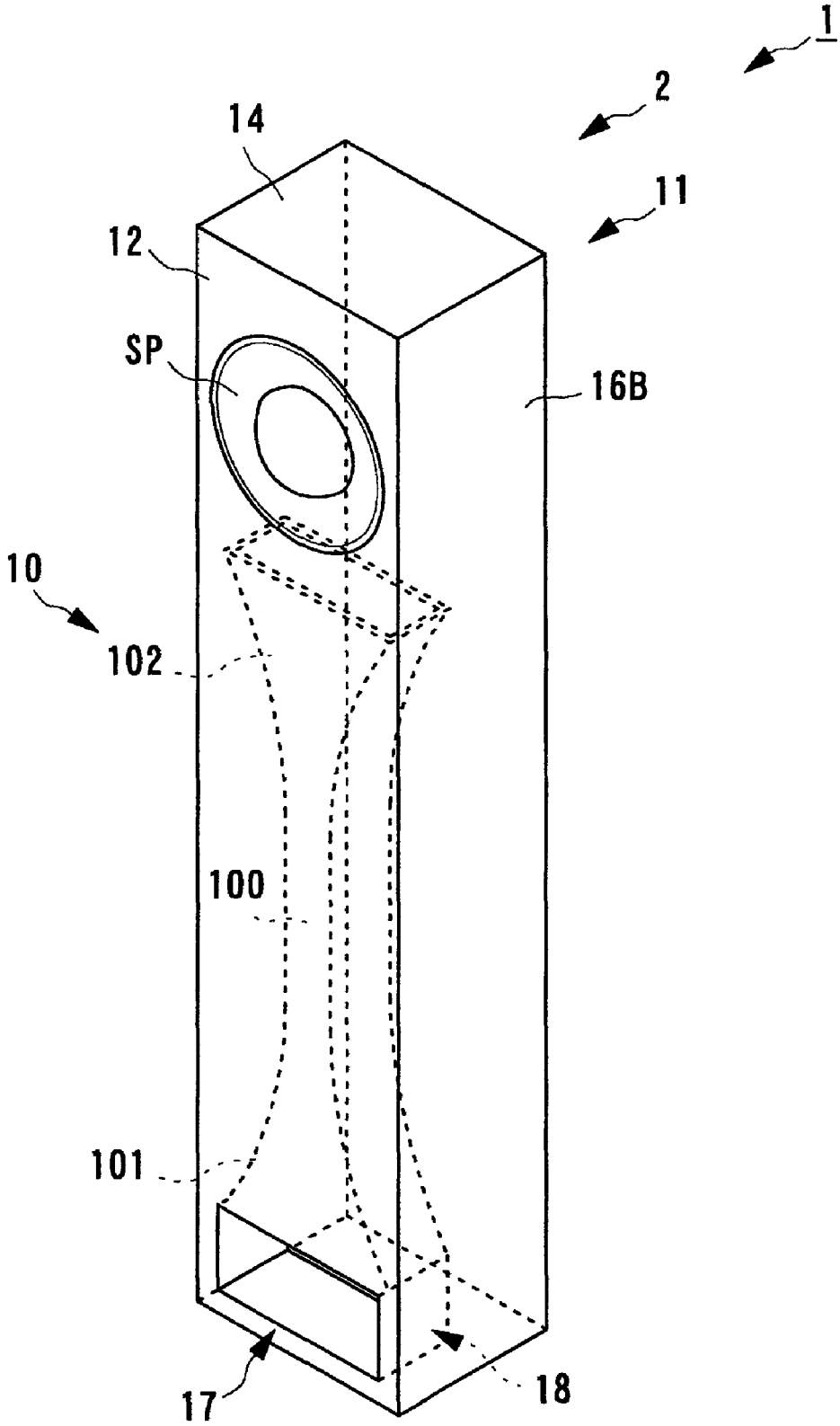
FIG. 1 is an external perspective view showing a speaker apparatus according to an embodiment of the present invention.
Figures 2A, 2B, 2C:
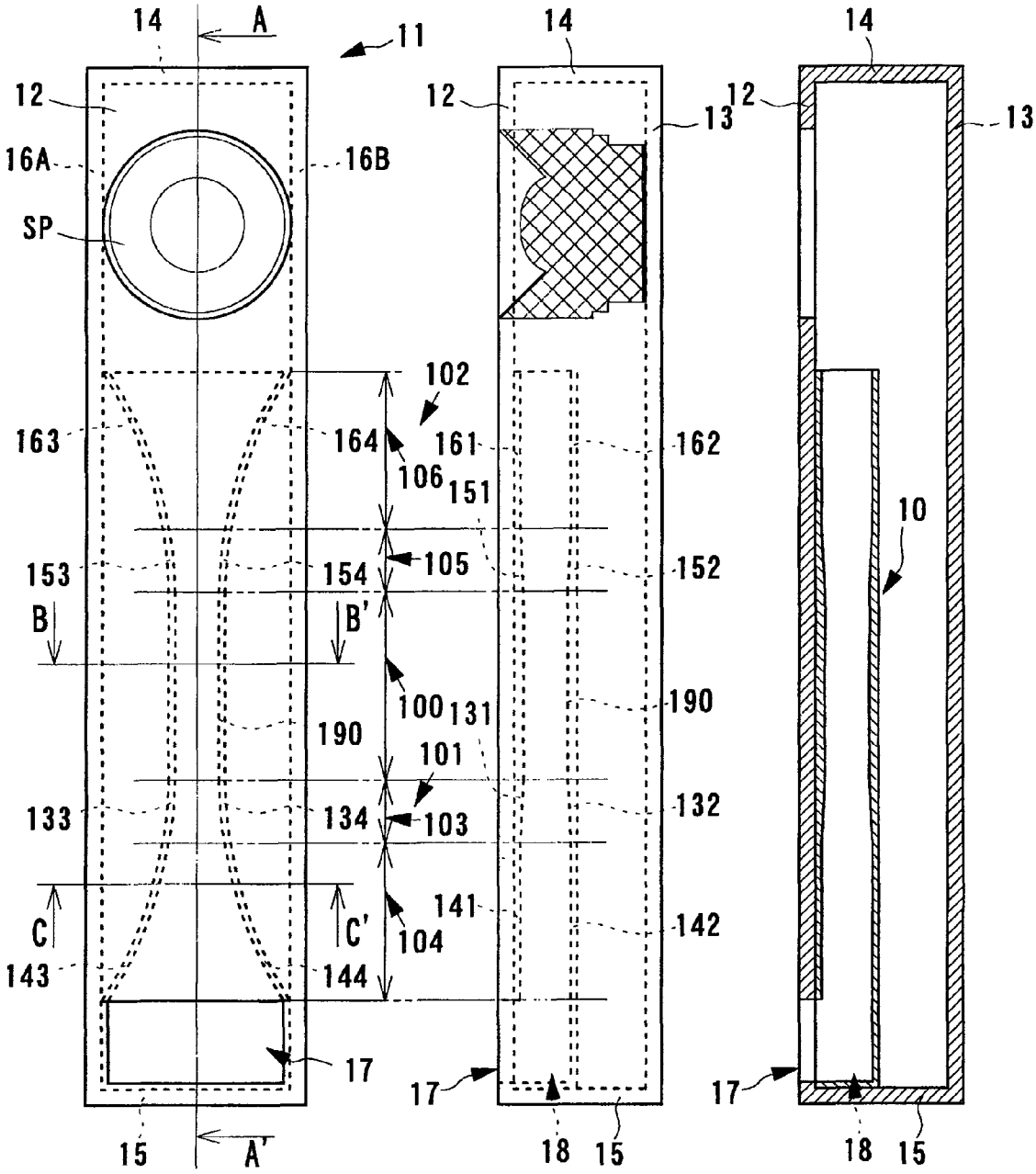
FIG. 2A is a front view showing the speaker apparatus shown in FIG. 1.
FIG. 2B is a side view showing the speaker apparatus shown in FIG. 1.
FIG. 2C is a cross-sectional view taken along line A-A' shown in FIG. 2A.
Figure 2D:
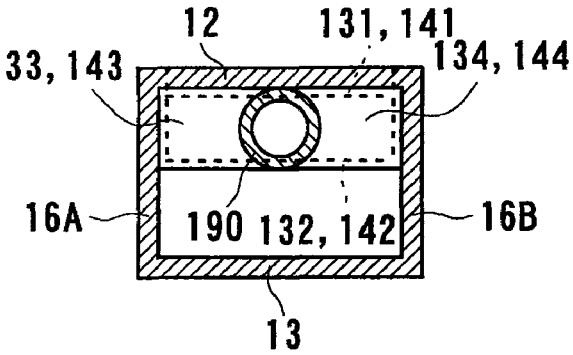
FIG. 2D is cross-sectional view taken along line B-B' shown in FIG. 2A.
Figure 2E:
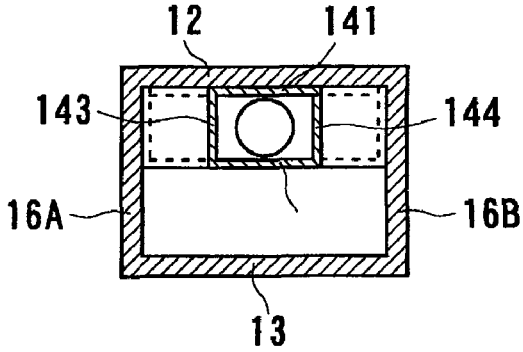
FIG. 2E is a cross-sectional view taken along line C-C' shown in FIG. 2A.

FIG. 1 is an external perspective view showing a speaker apparatus 1 according to the embodiment of the present invention. FIG. 2A is a front view showing the speaker apparatus 1 according to the present embodiment. FIG. 2B is a side view showing the speaker apparatus 1 according to the present embodiment. FIG. 2C is a cross-sectional view taken along line A-A' shown in FIG. 2A. FIG. 2D is cross-sectional view taken along line B-B' shown in FIG. 2A. FIG. 2E is a cross-sectional view taken along line C-C' shown in FIG. 2A.

As shown in FIG. 1 and FIG. 2A to FIG. 2E, a speaker apparatus 1 according to the embodiment of the present invention has a structure in which the signal wiring is routed in a phase inversion-type enclosure 2. The speaker apparatus 1 has a structure in which a speaker unit SP and a bass reflex port 10 are installed in a cabinet 11, and an opening 19 for the bass reflex port is formed.

The cabinet 11 has a rectangular parallelepiped shape, and is formed by a front panel 12 and a back panel 13, a top panel 14 and a bottom panel 15, and a pair of side panels 16A and 16B, with the principal surfaces thereof being mutually parallel. In the cabinet 11, the interval between the top panel 14 and the bottom panel 15 is longer than the intervals between the other panel surfaces. The direction that ties the top panel 14 and the bottom panel 15 is called the long direction, the direction that ties the side panels 16A, 16B is called the short direction, and the direction that ties the front panel 12 and the back panel 13 is called the depth direction. The dimensions of the cabinet 11 (enclosure 1) are determined as follows. That is, the length in the long direction of the cabinet 11 is set so that above-mentioned speaker unit SP, a bass reflex port 10, and a connecting space portion 18 are lined up in order in the long direction, with the speaker unit SP and the bass reflex port 10 disposed with a specified interval. The length in the short direction of the cabinet 11 is set according to the width of the speaker unit SP. The length of the depth direction of the cabinet 11 is set according to the depth of the speaker unit SP, and is a length in which the back end of the speaker unit SP abuts the back panel 13 via a shock absorbing material of a predetermined thickness (for example, 0.5 mm).

In the front panel 12, the speaker unit SP is installed, and a bass reflex port opening portion 17 is formed. The front panel 12 functions as a baffle panel. The speaker unit SP is installed at the top panel 14 side in the long direction of the front panel 12. The bass reflex port opening portion 17 is formed at the bottom panel 15 side in the long direction which is the opposite side of the top panel 14 side where the speaker unit SP is arranged. The bass reflex port 10 is formed on the front panel 12 at the inner surface side of the cabinet 11. The bass reflex port 10 is connected to the bass reflex port opening portion 17 via a connecting space portion 18.

The bass reflex port 10 includes a main tubular portion 100 having a shape that extends in the long direction, and air rectifiers 101, and 102 connected to both ends of the main tubular portion 100 in the long direction. The main tubular portion 100, and the air rectifiers 101 and 102 are hollow tubular shapes, and are formed so that their hollow central axes along the long direction are in agreement.

The main tubular portion 100 includes a hollow tubular portion 190 in which the shape of the hollow cross section perpendicular to the long direction (axial direction) is circular, and the area of the hollow cross section is uniform at each position in the long direction. The length and the inner diameter of this hollow tubular portion 190 are set based on the frequency of the bass to be enhanced in the enclosure 2. Since it is possible to shorten the length of the main tubular portion 100 as the inner diameter narrows, the cross-sectional area of the inner diameter of the hollow tubular portion 190 is set to become smaller than the effective area of the speaker unit SP. For example, the hollow cross-sectional area of the main tubular portion 100 is set to 0.2 to 1.0 times the effective area of the speaker unit SP.

The air rectifier 101 includes an inner shape transformation portion 103 and a main transformation portion 104. The air rectifier 101 is connected to the opening end of the main tubular portion 100 on the side of the bass reflex port opening portion 17. The inner shape transformation portion 103 and the main transformation portion 104 are successively formed sequentially from the connection side with the main tubular portion 100.

The hollow cross-sectional shape of the inner shape transformation portion 103 is, at the end portion on the side of the main tubular portion 100, the same circular shape as the hollow tubular portion 190 and, at the end portion on the side of the main transformation portion 104, is of a square shape the side length of which is the same as the inner diameter of the hollow tubular portion 190 or slightly longer than this inner diameter in every direction. Walls 131 to 134 of the inner shape transformation portion 103 are formed so that the hollow cross section of the inner shape transformation portion 103 gradually changes from the circular shape to the square shape described above.

The hollow cross-sectional shape of the main transformation portion 104, at the end portion on the side of the inner shape transformation portion 103, has the same square shape as the inner shape transformation portion 103, and at the end portion on the side of the bass reflex port opening portion 17 (connecting space portion 18), has a rectangular shape with a larger area than the area of the end portion on the side of the inner shape transformation portion 103.

Among walls 141 to 144 that form the hollow of the main transformation portion 104, the wall 141 and the wall 142 that face each other in the depth direction of the cabinet 11 respectively connect to the wall 131 and the wall 132 that face each other in the depth direction of the inner shape transformation portion 103. The wall 141 and the wall 142 are installed so that the surfaces that face each other become parallel. With this structure, the interval between the wall 141 and the wall 142 becomes the same regardless of the interval between the opposing surfaces in the short direction, and so the hollow shape of the main transformation portion 104 does not widen in the depth direction. The interval between the wall 143 and the wall 144 that face each other in the short direction of the cabinet 11 gradually widens from the side of the inner shape transformation portion 103 to the side of the bass reflex port opening portion 17 in accordance with an exponential function.

By having such a structure, the air rectifier 101 has a shape in which the hollow cross-sectional area gradually becomes large from the side where it connects to the main tubular portion 100 to the side of the bass reflex port opening portion 17 without changing the interval of the walls with respect to the depth direction of the cabinet 11.

The air rectifier 102 includes an inner shape transformation portion 105 and a main transformation portion 106. The air rectifier 102 is connected to the opening end of the main tubular portion 100 on the side of the speaker unit SP. The inner shape transformation portion 105 and the main transformation portion 106 are successively formed sequentially from the connection side with the main tubular portion 100.

The hollow cross-sectional shape of the inner shape transformation portion 105 is, at the end portion on the side of the main tubular portion 100, the same circular shape as the hollow tubular portion 190 and, at the end portion on the side of the main transformation portion 106, is of a square shape the side length of which is the same as the inner diameter of the hollow tubular portion 190 or slightly longer than this inner diameter in every direction. Walls 151 to 154 of the inner shape transformation portion 105 are formed so that the hollow cross section of the inner shape transformation portion 105 gradually changes from the circular shape to the square shape described above.

The hollow cross-sectional shape of the main transformation portion 106, at the end portion on the side of the inner shape transformation portion 105, has the same square shape as the inner shape transformation portion 105, and at the end portion on the side of the speaker unit SP, has a rectangular shape with a larger area than the area of the end portion on the side of the inner shape transformation portion 105. Among walls 161 to 164 that form the hollow of the main transformation portion 106, the wall 161 and the wall 162 that face each other in the depth direction of the cabinet 11 respectively connect to the wall 151 and the wall 152 that face each other in the depth direction of the inner shape transformation portion 105. The wall 161 and the wall 162 are installed so that the surfaces that face each other become parallel. With this structure, the interval between the wall 161 and the wall 162 becomes the same regardless of the interval between the opposing surfaces in the short direction, and so the hollow shape of the main transformation portion 106 does not increase in the depth direction. The interval between the wall 163 and the wall 164 that face each other in the short direction of the cabinet 11 gradually widens from the side of the inner shape transformation portion 105 to the side of the speaker unit SP in accordance with an exponential function.

By having such a structure, the air rectifier 102 has a shape in which the hollow cross-sectional area gradually becomes large from the side where it connects to the main tubular portion 100 to the side of the speaker unit SP without changing the interval of the walls with respect to the depth direction of the cabinet 11.

In the enclosure 2 having this kind of structure, the operation as shown below arises by the oscillation of the speaker unit SP.

Figure 3A:
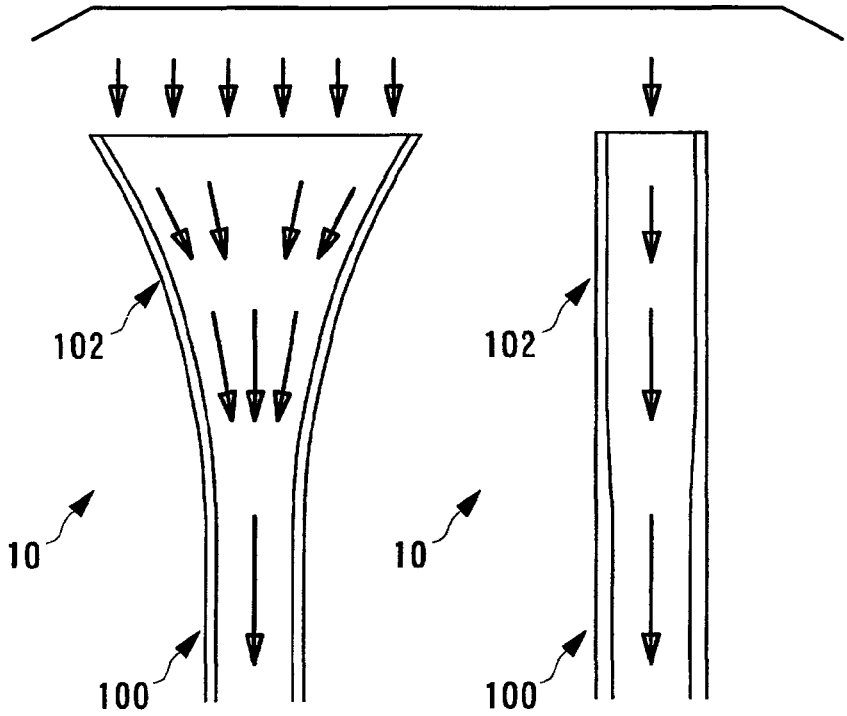
FIG. 3A is an explanatory view showing a process of airflow of a speaker unit at an air inlet side of the bass reflex port shown in FIG. 1.
Figure 3B:
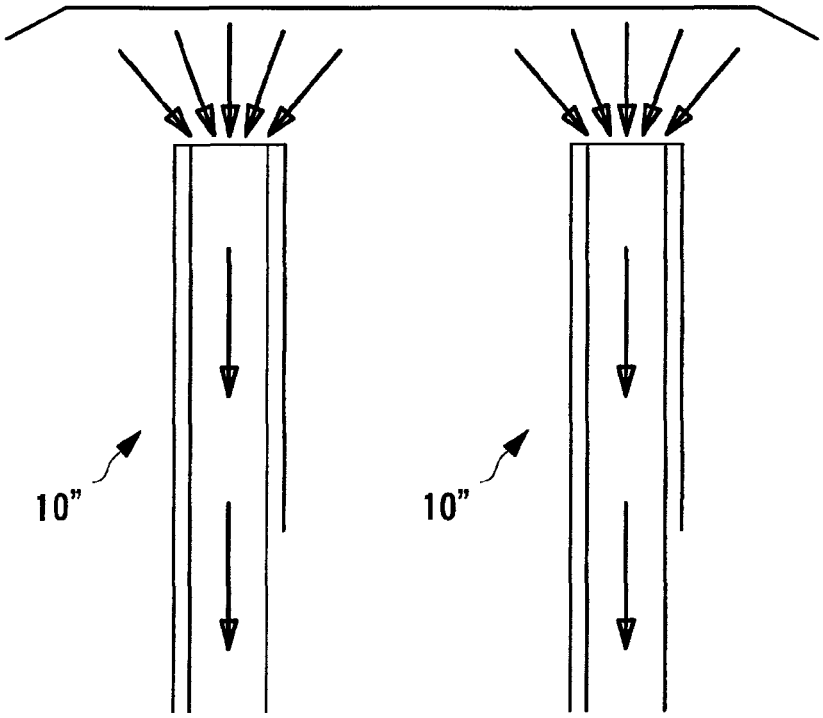
FIG. 3B is an explanatory view showing a process of airflow of a speaker unit at an air inlet side of a conventional bass reflex port.
Figure 4A:
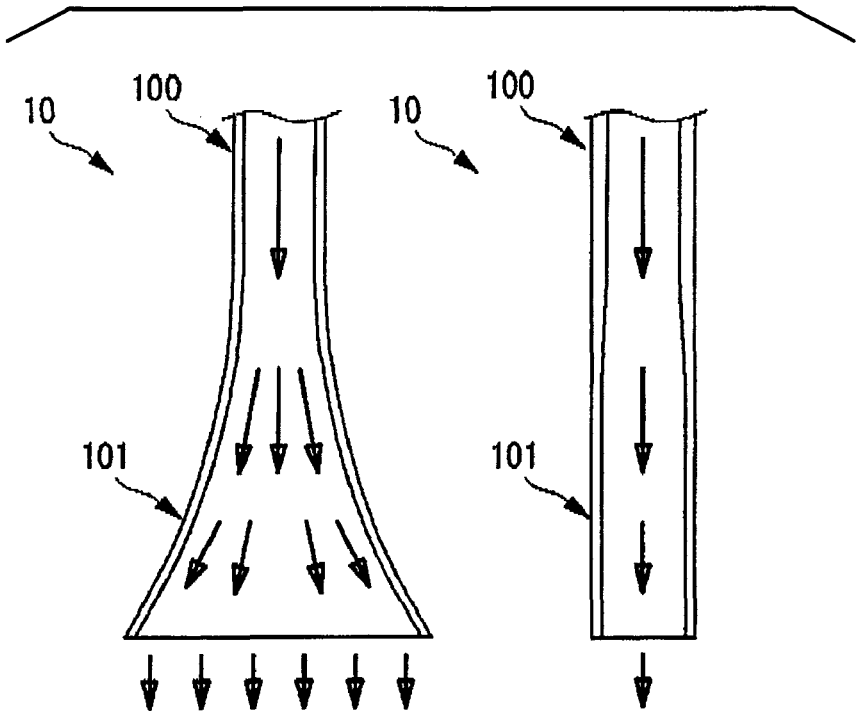
FIG. 4A is an explanatory view showing a process of airflow of the speaker unit at an air discharge side of the bass reflex port shown in FIG. 1.
Figure 4B:
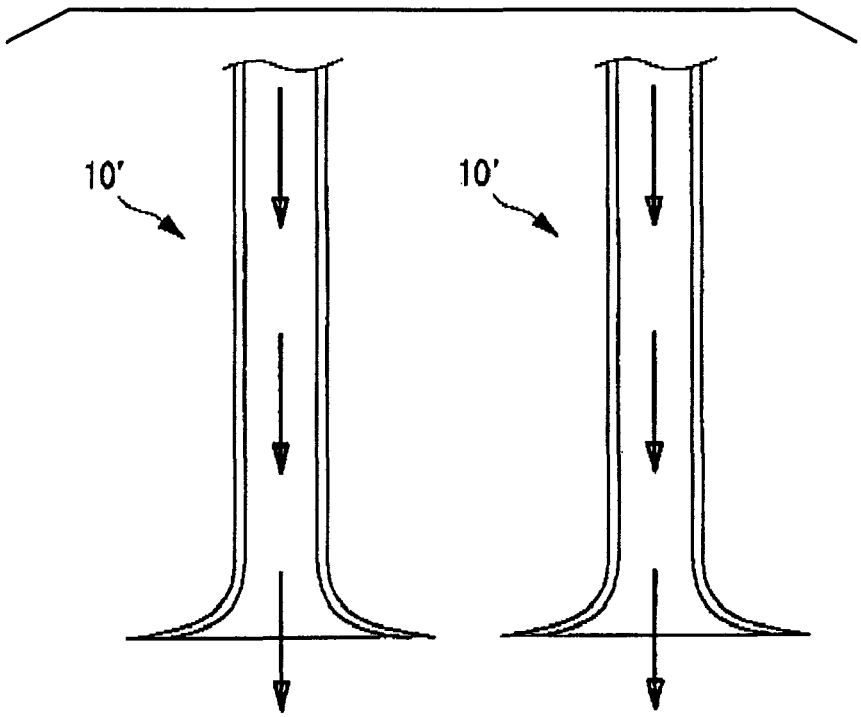
FIG. 4B is an explanatory view showing a process of airflow of a speaker unit at an air discharge side of a conventional bass reflex port.

FIGS. 3A and 3B, and FIGS. 4A and 4B are explanatory views showing the process of air flow in the case of air being drawn in from the side of the air rectifier 102 and discharged from the side of the rectification portion 101, comparing the constitution of the speaker unit 1 according to the embodiment of the present invention and a conventional speaker unit, respectively. FIG. 3A shows the process of airflow at the air inlet side in the bass reflex port 10 of the speaker unit 1. FIG. 3B shows the process of airflow at the air inlet side in a conventional bass reflex port 10" having a simple tubular shape. FIG. 4A shows the process of airflow at the air discharge side in the bass reflex port 10 of the speaker unit 1. FIG. 4B shows the process of airflow at the air discharge side due to the bass reflex port that adds a radial roundness to the angle of the opening end of the conventional bass reflex port. In FIGS. 3A and 3B, and FIGS. 4A and 4B, the outline arrows in the figures indicate airflow, with the arrow directions indicating the airflow direction, and the arrow lengths indicating the flow velocity. In FIGS. 3A and 3B, and FIGS. 4A and 4B, the left-side portion shows a vertical cross section of the bass reflex port, while the right-side portion shows a section of the bass reflex port in a direction perpendicular to this vertical section.

The hollow cross-sectional area at the opening end of the air rectifier 102 on the side of the speaker unit SP is significantly larger compared to that of the main tubular portion 100. The hollow cross-sectional area at the opening end of the air rectifier 102 on the side of the speaker unit SP is approximately the same as the effective area of the speaker unit SP. For this reason, at the opening end of the air rectifier 102 on the side of the speaker unit SP, the air intake flow velocity becomes very low, and turbulence hardly occurs at this opening end.

Also, since the cross-sectional area of the hollow of the air rectifier 102 smoothly decreases in accordance with an exponential function along the direction of movement of the air, when the air passes the air rectifier 102, turbulence is not generated.

Moreover, at the connection portion of the air rectifier 102 and the main tubular portion 100, by using the inner shape transformation portion 105, the hollow cross-sectional shape is smoothly transformed from the square shape corresponding to the main transformation portion 106 of the air rectifier 102 into a circular shape corresponding to the main tubular portion 100. Thereby, even if the flow velocity of the air increases in the main tubular portion 100, when the air flows from the air rectifier 102 to the main tubular portion 100, turbulence does not occur. In this way, the air rectifier 102 can significantly suppress turbulence during air intake, and the generation of noise can be significantly suppressed due to the turbulence.

The main tubular portion 100 has a uniform hollow cross-sectional area that is smaller than the effective area of the speaker unit SP as described above. The main tubular portion 100 passes the air that has flowed in from the air rectifier 102 at a predetermined flow velocity, and outputs it to the air rectifier 101. At this time, since the main tubular portion 100 has a tubular shape with a regular form, turbulence does not occur within the main tubular portion 100. Thereby, the main tubular portion 100 can excite the Helmholtz resonance at a desired frequency without generating turbulence.

In the connection portion of the main tubular portion 100 and the air rectifier 101, by using the inner shape transformation portion 103, the hollow cross-sectional shape is smoothly transformed from the circular shape corresponding to the main tubular portion 100 into the square shape corresponding to the main transformation portion 104. Moreover, when the main tubular portion 100 is compared with the inner shape transformation portion 103, the hollow cross-sectional areas are the same, or that of the inner shape transformation portion 103 is slightly larger. For this reason, the air that flows from the main tubular portion 100 into the inner shape transformation portion 103 flows along the walls of the inner shape transformation portion 103. That is, the air that flows into the inner shape transformation portion 103 passes through the inside of the inner shape transformation portion 103 while coming under the influence of the inner wall surfaces of the inner shape transformation portion 103.

The hollow cross-sectional area of the main transformation portion 104 of the air rectifier 101 smoothly increases in accordance with an exponential function along the direction of movement of air. However, since the interval between the wall 141 and the wall 142 is uniform, within the main transformation portion 104, pressure continues to be applied from the wall 141 and the wall 142 to the air that tries to diffuse in the direction of the wall 141 and the wall 142. For this reason, the air spreads out in the direction of the wall 143 and the wall 144 whose mutual distance gradually increases, and continues to come under the influence of the pressure from the wall 143 and the wall 144. That is, the air that flows through the main transformation portion 104 always continues to come under the influence of the walls 141 to 144 to flow while spreading throughout the entire hollow cross section. In this way, in the main transformation portion 104, since the cross sectional area thereof gradually increases, the flow velocity of the air that flows while spreading throughout the entire hollow cross section gradually decreases. Then, since the cross sectional area of the opening end of the main transformation portion 104 on the side of the bass reflex port opening portion 17 reaches a size corresponding to the speaker unit SP, the flow velocity of air sufficiency decreases. That is, the flow velocity of the air discharged from the air rectifier 101 becomes significantly lower compared to that of the main tubular portion 100.

Figure 5A:
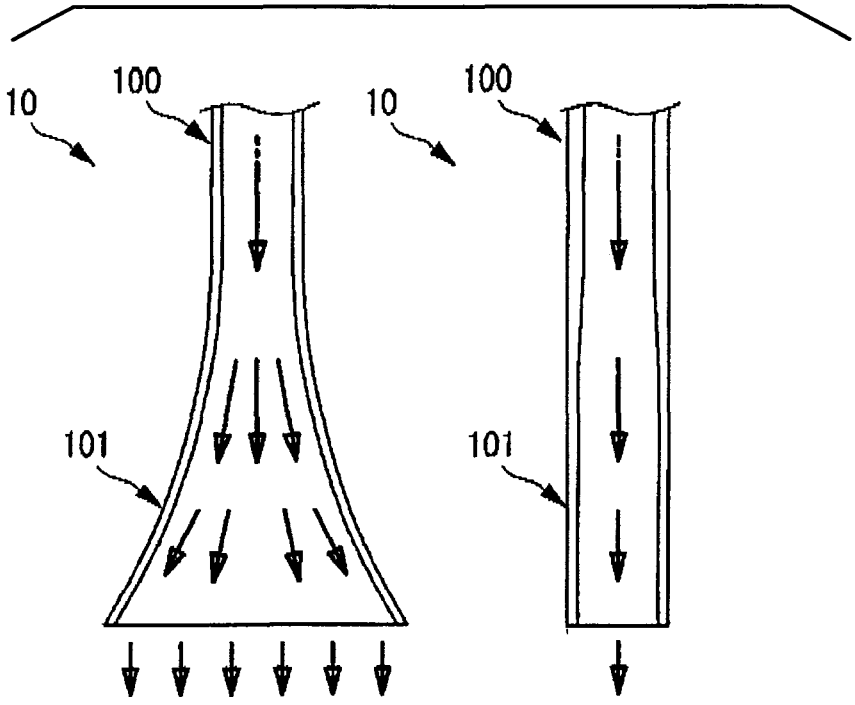
FIGS. 5 A and 5B show another principle of lowering the discharge air flow velocity.
Figure 5B:
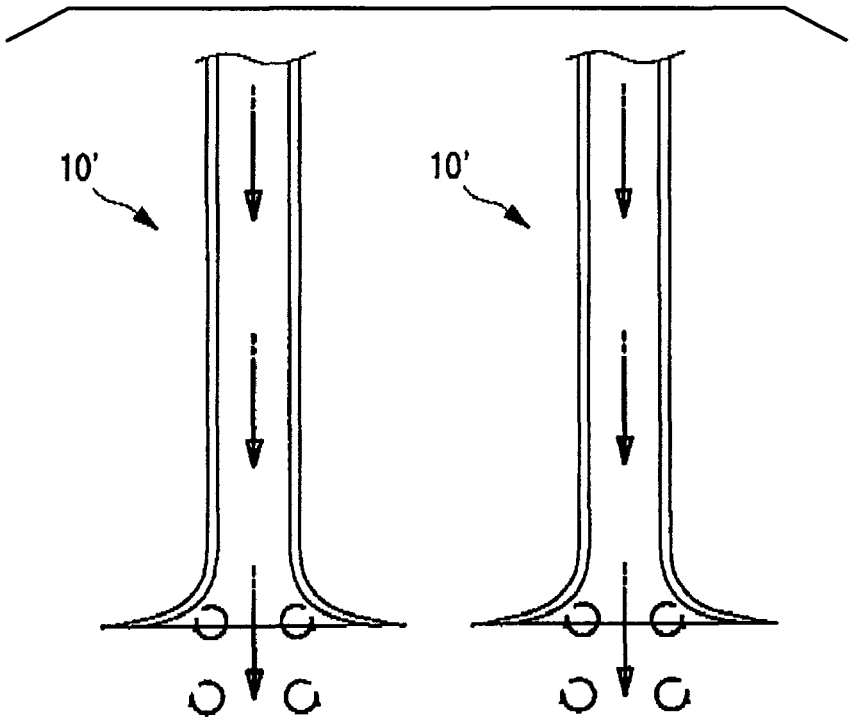

FIGS. 5 A and 5B show another principle of lowering the discharge air flow velocity. FIG. 5A shows the case of the constitution of the present embodiment, while FIG. 5B shows a conventional constitution. In FIGS. 5A and 5B, the outline arrows indicate airflow, with the arrow directions indicating the airflow direction, and the arrow lengths indicating the flow velocity, and the circular arrows indicates vortex air flow, with the arrow directions indicating the rotation direction of the air flow.

Generally, in the case of a gas being discharged from a tubular body at a predetermined flow velocity, since the pressure is rapidly released, a vortex air flow is generated from the opening end of the tubular body. This vortex air flow becomes an air flow that follows an arc from the central axis of the tubular body in the radiation direction when the opening face of the tubular body is viewed from the front. If this vortex current does not receive an external pressure, it is an air flow that moves straight ahead while gradually diffusing in the radiation direction. For this reason, in the case of the opening portion of the tubular body being a shape that cuts off the tubular body without gradually expanding, since the vortex air flow is generated along the central axis direction of the tubular body and it moves ahead a long way while maintaining strength, when a structure such as a grill or punching metal is arranged on the outside of the opening portion, noise is generated by the collision of the vortex air flow.

Here, as shown in FIG. 5B, in a structure that adds a roundness to the angle of a conventional opening end such that the cross-sectional area increases from the main tubular portion that consists of a constant diameter with respect to all radiation directions simultaneously, the vortex air flow is generated and it moves ahead a long way while maintaining strength. That is, at the point in time at which the rate of increase of the cross-sectional area within the walls of the bass reflex port has become greater than the surface change of the natural diffusion of the aforementioned vortex air flow, since the pressure from the walls of the bass reflex port is released simultaneously in all directions, vortex air flows are generated, and the air that is discharged from the bass reflex port advances without the flow velocity decreasing and generating vortex air flows. On the other hand, when attempting to reduce the rate of increase of the cross-sectional area, inevitably the curvature radius of the roundness that is added to the angle of the opening portion increases. Thus it cannot be applied to a small speaker apparatus.

However, by using the constitution of the present embodiment shown in FIG. 5A, at the point in time when the air is discharged from the main tubular portion 100 to the air rectifier 101, since the interval between the wall 141 and the wall 142 is uniform, the air flow continues to receive pressure from these walls 141, 142, and so diffusion in the direction of the walls 141, 142 is suppressed, and it is diffused in the direction of the walls 143, 144 whose interval gradually widens. Thereby, the air flow moves ahead while diffusing along the walls 143, 144 without advancing straight ahead along the central axis of the main tubular portion 100 and the air rectifier 101. As a result, during the discharge of air, as the pressure and flow velocity gradually decrease within the air rectifier 101, at the opening end of the air rectifier 101 on the side of the bass reflex port opening portion 17, hardly any air flow is generated, and so vortex air flows are hindered from occurring. Accordingly, by making the cross-sectional area of the opening end comparable to the effective area of the speaker unit SP (and if larger even better), it is possible to sufficiently decrease the air discharge flow velocity of the bass reflex port 10. Moreover, even if the area of the opening end is made significantly smaller by suitably designing the shape of the air rectifier 101 in accordance with the specifications of the speaker apparatus (even if around 1/10 of the effective area of the speaker unit SP), it is possible to suppress the generation of noise.

The air whose flow velocity has decreased in this way is discharged to the outside from the bass reflex port opening portion 17 via the connecting space portion 18. Accordingly, the bass portion that has been amplified by the bass reflex port is emitted at a slow flow velocity from the bass reflex port opening portion 17. At this time, since the discharge flow velocity from the bass reflex port 10 (the air rectifier 101) is slow, even though the emission direction is changed from the bottom direction to the front direction by the connecting space portion 18, the air that is discharged from the bass reflex portion 10 gently flows through the connecting space portion 18, and so this air does not generate noise by colliding at a high speed with the walls of the connecting space portion 18. For this reason, even if for example a grill is arranged on the front of the bass reflex port opening portion 17, noise is not generated.

The bass reflex port operates by drawing in and discharging air from both opening portions by turns. It also exists a process of drawing in air from the air rectifier 101 via the connecting space portion 18 from the bass reflex port opening portion 17 and discharging the air from the air rectifier 102. In this case, the air rectifier 101 performs the aforementioned air intake process of the air rectifier 102, and the air rectifier 102 performs the air discharge process of the air rectifier 101.

Since the air rectifier 101 and the air rectifier 102 have the same structure, even in the case of drawing in air from the bass reflex port opening portion 17, it is possible to suppress the generation of turbulence during the air intake and reduce the air discharge flow velocity as described above. In this case, although the discharged air advances in the direction of the speaker unit SP, since the air discharge flow velocity is slow, it is possible to suppress noise that may occur due to oscillation of the diaphragm of the speaker unit SP from this discharged air.

Figure 6:
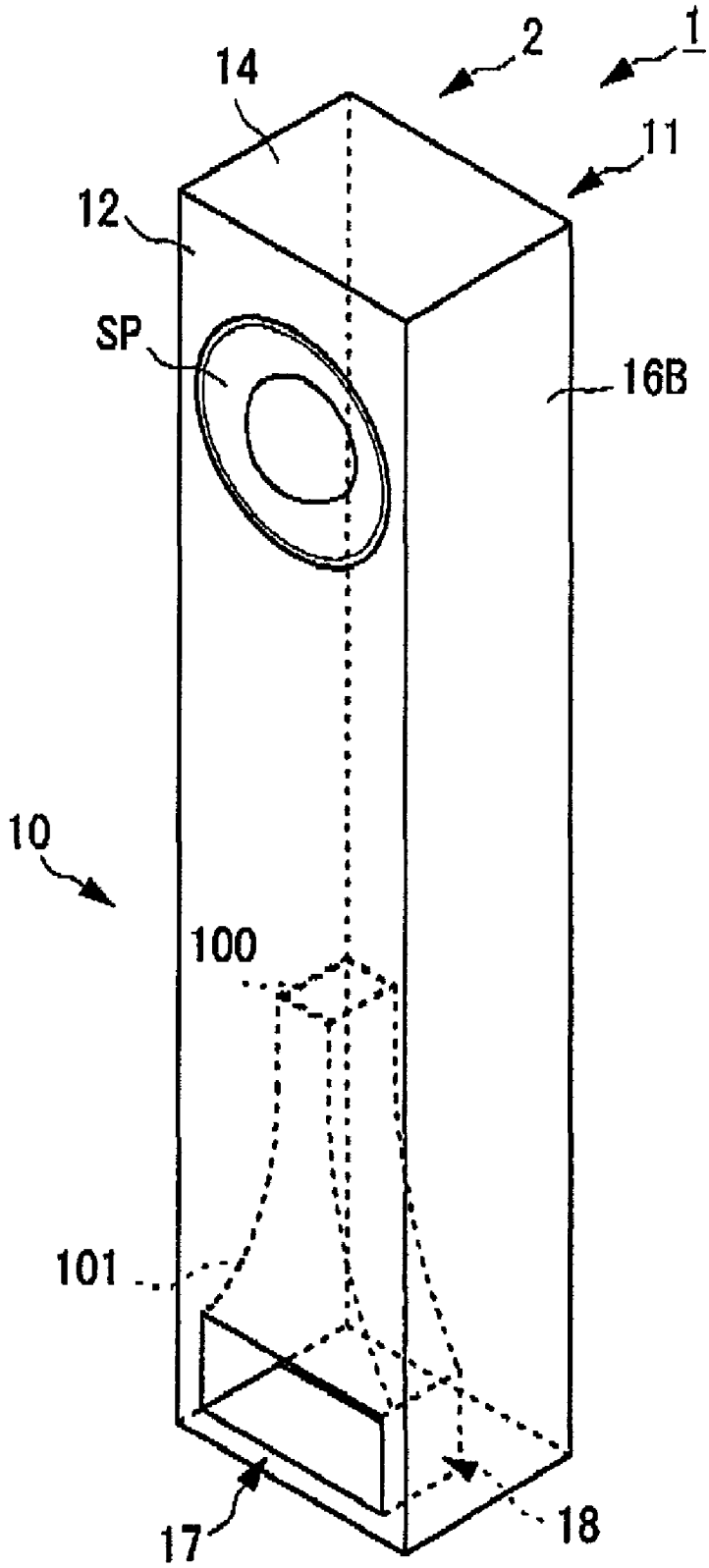
FIG. 6 is an external perspective view showing the case of an air rectifier being arranged only at one end of a main tubular portion according to another example of the first embodiment of the present invention.

Note that the bass reflex port 10 is not limited to a structure in which the air rectifier 101 and the air rectifier 102 are installed at both ends of the main tubular portion 100 as described above. For example, as shown in FIG. 6, the bass reflex port 10 may have a structure in which the air rectifier 101 is installed at only one end of the main tubular portion 100. In this case as well, at the side in which the air rectifier is installed, the above-mentioned action during air intake and the action during air discharge are obtained.

As described above, by using the constitution of the present embodiment, it is possible to achieve a speaker apparatus that suppresses the generation of noise stemming from the bass reflex port with a simple structure. Moreover, by using the constitution of the present embodiment, even if obstacles such as a wall or grill or the like exist in the vicinity of the air discharge opening of the bass reflex port, noise is not generated due to this discharged air colliding with them. Therefore, it is possible to arrange other elements that constitute the enclosure near the bass reflex port. Thereby, it is possible to downsize the shape of the enclosure, that is, the cabinet. As a result, it is possible to achieve a compact speaker unit with low noise and enhanced bass by means of a simple constitution.

Figure 7A:
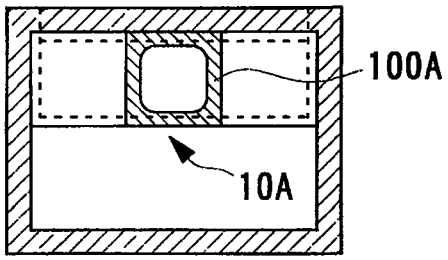
FIGS. 7A to 7D show structure examples of the bass reflex ports according to the embodiment of the present invention.
Figure 7C:
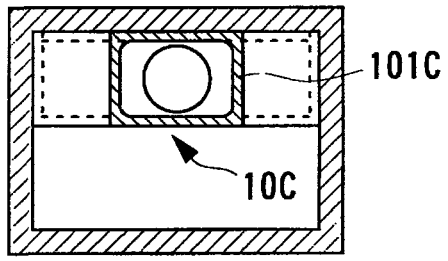
Figure 7B:
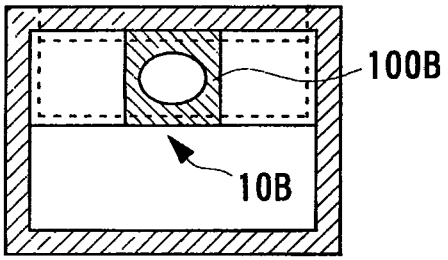

While, in the above description, the hollow cross-sectional shape of the main tubular portion is circular, the hollow cross-sectional shape of the main tubular portion may be made into a polygonal shape such as square or rectangular, an elliptical shape or, an oblong shape like main tubular portions 100A and 100B shown in FIGS. 7A and 7B. In this case, in the polygonal shape, if each corner portion is round-chamfered it is more effective. That is, the hollow cross section of the main tubular portion may be plane symmetrical with respect to an axis of symmetry of the hollow cross section, and the distance between two points where the axis of symmetry and the hollow cross section of the main tubular portion intersect may be made constant. Here, an axis of symmetry is defined as a line through a shape so that each side is a mirror image.

Figure 7D:
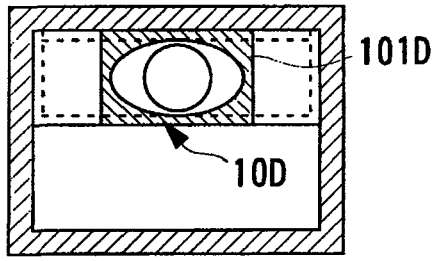

Furthermore, while, in the above description, the hollow cross section of the air rectifiers 101 and 102 is rectangular, as long as the interval between one pair of facing walls is the same, the hollow cross section of the air rectifier may be made into a shape in which the corner portions of this rectangular shape are round-chamfered or an elliptical shape and oblong shape like air rectifiers 101C and 101D shown in FIG. 7C and FIG. 7D. That is, the hollow cross section of each air rectifier may be plane symmetrical with respect to an axis of symmetry of the hollow cross section, and the distance between two points where the axis of symmetry and the hollow cross section of the air rectifier intersect may be made constant. FIGS. 7A to 7D show other constructional examples of bass reflex ports according to the embodiment of the present invention.

Also, while, in the aforementioned description, the example is shown of installing the air rectifiers at both ends of the main tubular portion of the bass reflex portion, a structure is also possible that installs an air rectifier at only either one end.

Also, in the aforementioned description, the example is shown of the distance between a pair of walls on the side in which the wall interval of the air rectifier changes changing in accordance with an exponential function. However, provided it is a shape in which corner portions do not occur in the inner wall surface, it is acceptable to use another structure in which the wall interval monotonically increases (decreases) in the long direction.

Also, while, in the aforementioned description, the example is shown in which the central axis of the hollow portion of the main tubular portion and the central axis of the hollow portion of the air rectifier agree along the long direction of the bass reflex port, a structure is also acceptable in which they are shifted slightly.

Also, in the aforementioned description, the example is shown of installing the bass reflex port on the side of the front panel. However, provided it is within the enclosure portion, it may be installed at another panel.

Next, a speaker apparatus according to a second embodiment of the present invention shall be described referring to the drawings.

Figure 8:
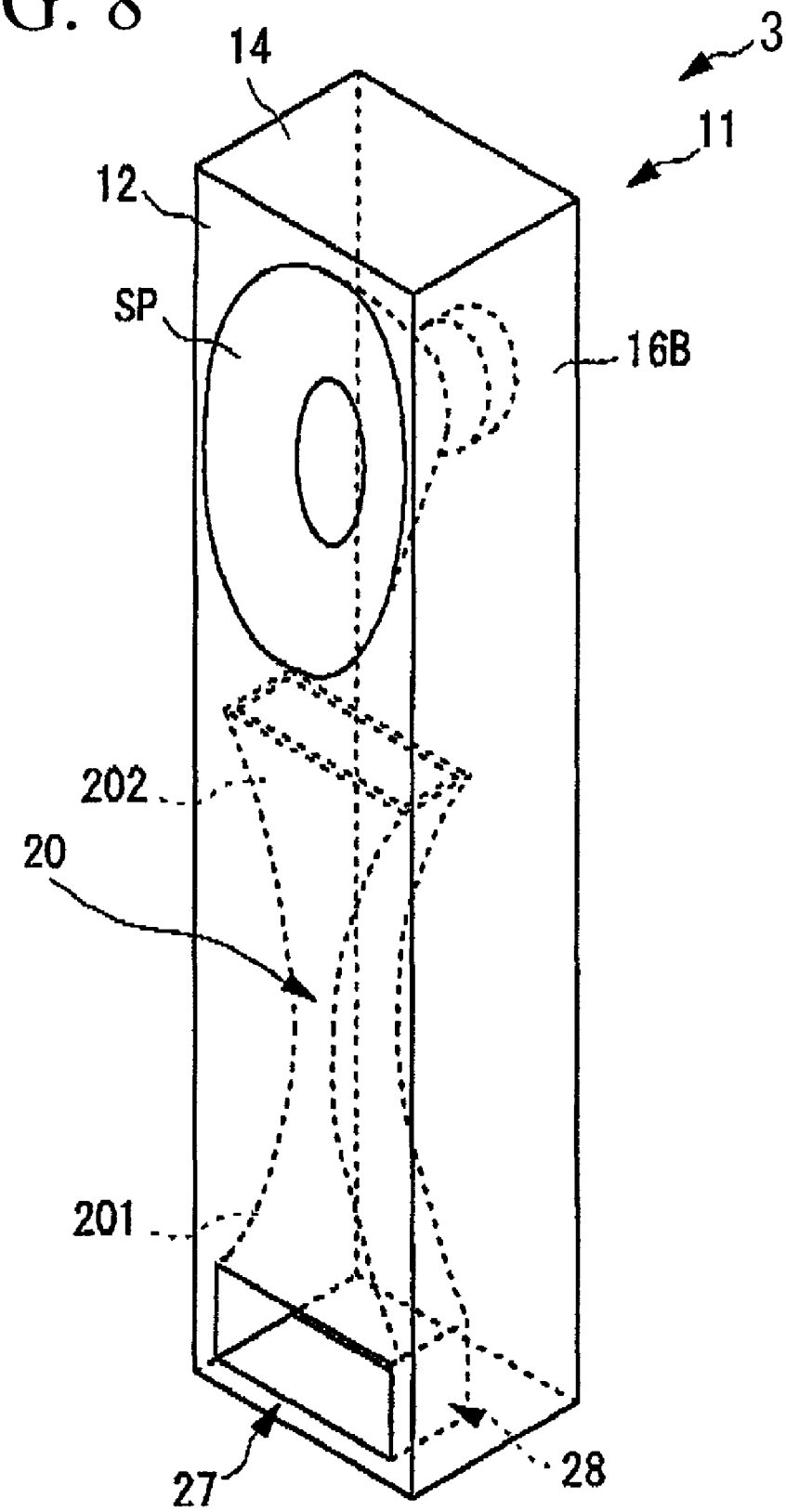
FIG. 8 is an external perspective view showing a speaker apparatus according to a second embodiment of the present invention.
Figure 9A:
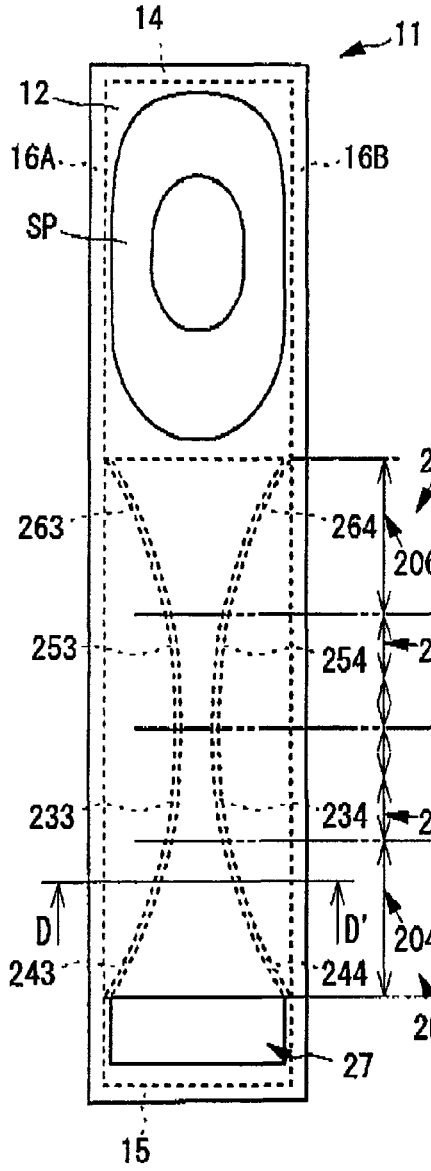
FIG. 9 A is a front view showing the speaker apparatus shown in FIG. 8.
FIG. 9C is a cross-sectional view showing the speaker apparatus shown in FIG. 8.
Figure 9B:
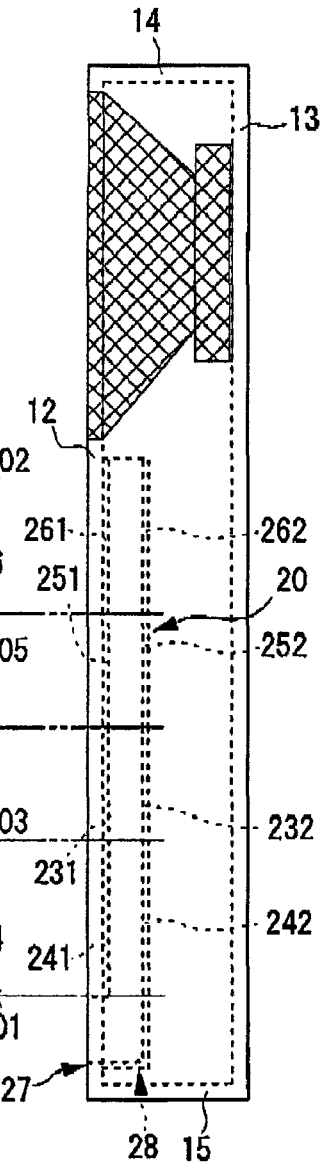
Figure 9C:
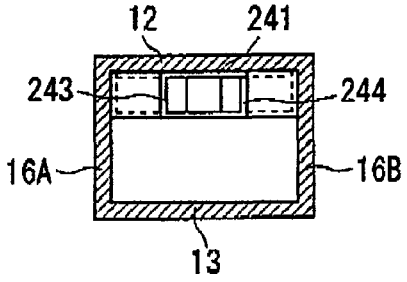
Figure 10:
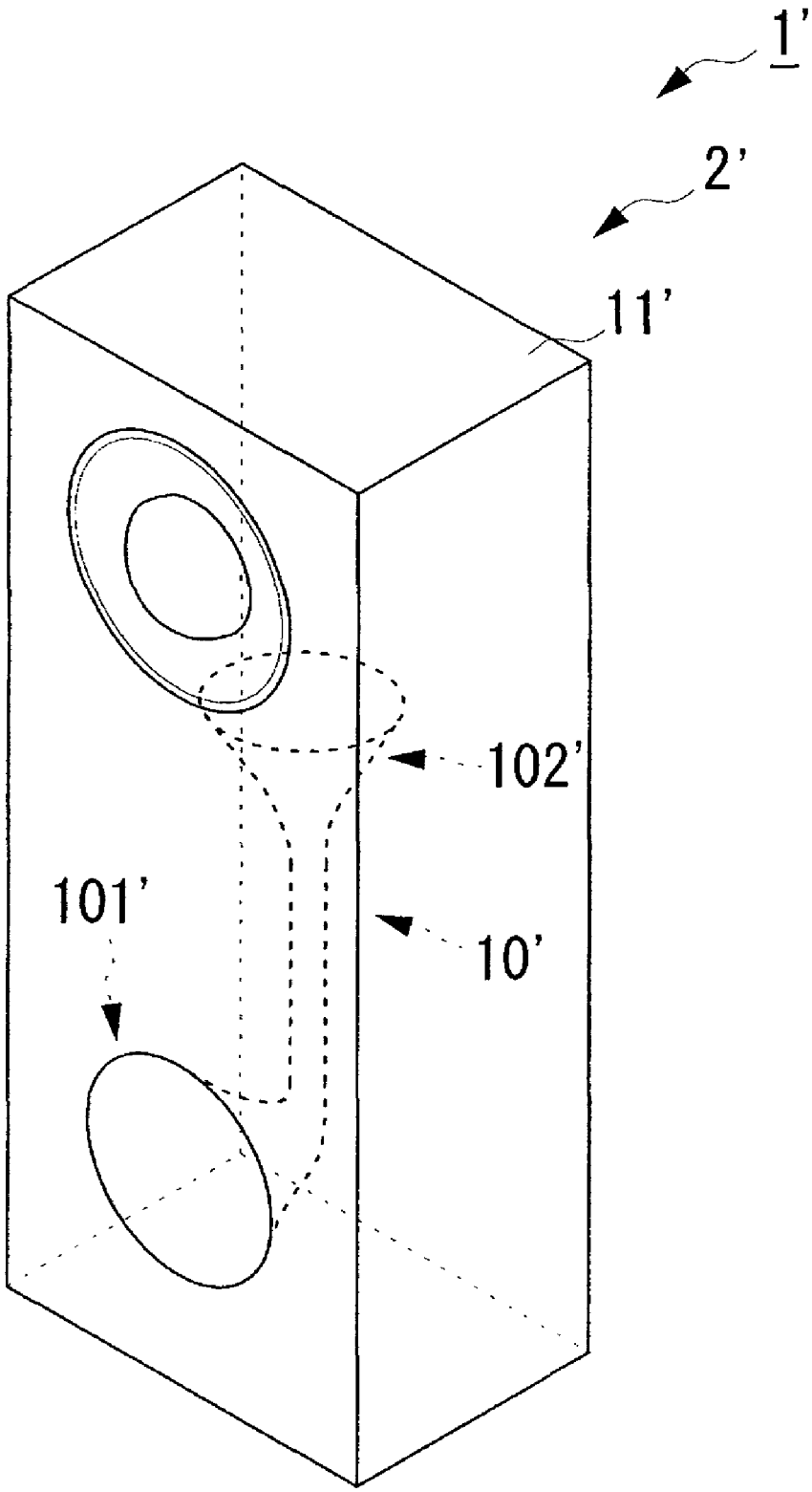
FIG. 10 shows various structures of a conventional general phase inversion-type enclosure.

FIG. 8 is an external perspective view showing a speaker apparatus according to the second embodiment of the present invention. Also, FIG. 9A is a front view showing the speaker apparatus 3 according to the second embodiment of the present invention. FIG. 9B is a side view showing the speaker apparatus 3 according to the second embodiment of the present invention. FIG. 9C is a cross-sectional view taken along D-D' shown in FIG. 9A.

The speaker apparatus (enclosure) 3 of the present embodiment includes a structure that abbreviates the main tubular portion 100 with respect to the bass reflex port of the speaker apparatus shown in the first embodiment.

As shown in FIG. 8 and FIG. 9, the speaker apparatus of the present embodiment, similarly to the speaker apparatus 1 shown in the first embodiment, has a structure in which a speaker unit SP and a bass reflex port 20 are installed in a cabinet 11, and a bass reflex port opening portion 27 is formed.

The arrangement of the speaker unit SP and the bass reflex port opening portion 27 in the cabinet 11 is the same as the arrangement of the speaker unit SP and the bass reflex port opening portion 17 shown in the first embodiment.

The bass reflex port 20 includes air rectifiers 201 and 202 that have tubular bodies that extend in the long direction of the cabinet 11, and the air rectifiers 201 and 202 are connected so as to be continuous along the long direction and are formed so that the central axes along the long direction of the tubular bodies agree. These air rectifiers 201 and 202 constitute a bass reflex port that is provided with a tubular body that has a shape in which the hollow cross-sectional area gradually increases along the axial direction from the location where the hollow cross-sectional area is smallest toward the opening ends of the bass reflex port.

The air rectifier 201 is arranged on the side of the bass reflex port opening portion 27 with respect to the air rectifier 202, and a bass intensifying operation portion 203 and a main transformation portion 204 are continuously formed from the side that connects to the air rectifier 202.

The hollow shape of the bass intensifying operation portion 203 is formed to be rectangular in cross section. Walls 231 to 234 of the bass intensifying operation portion 203 are formed so that the hollow cross-sectional area gradually increases from the side that connects to the air rectifier 202 toward the side of the bass reflex port opening portion 27. At this time, the bass intensifying operation portion 203 is formed so that the distance between the walls 231 and 232 of the bass intensifying operation portion 203 is constant along the long direction.

The hollow shape of the main transformation portion 204 is formed to be rectangular in cross section which is the same as that of the bass intensifying operation portion 203. Walls 241 to 244 of the main transformation portion 204 is formed so that the hollow cross-sectional area gradually increases from the side of the bass intensifying operation portion 203 toward the end on the side of the bass reflex port opening portion 27 (a connecting space portion 18). At this time, the distance between the walls 241 and 242 of the main transformation portion 204 is set so as to be the same as the distance between the walls 231 and 232 of the bass intensifying operation portion 203 and a constant distance. The wall 243 of the main transformation portion 204 is formed so as to be smoothly continuous with the wall 233 of the bass intensifying operation portion 203. The wall 244 of the main transformation portion 204 is formed so as to be smoothly continuous with the wall 234 of the bass intensifying operation portion 203.

Meanwhile, the air rectifier 202 is arranged on the side of the speaker unit SP with respect to the air rectifier 201, and a bass intensifying operation portion 205 and a main transformation portion 206 are continuously formed from the side that connects to the air rectifier 201.

The hollow shape of the bass intensifying operation portion 205 is formed to be rectangular in cross section. Walls 251 to 254 of the bass intensifying operation portion 205 are formed so that the hollow cross-sectional area gradually increases from the side that connects to the air rectifier 201 toward the side of the speaker unit SP. At this time, the bass intensifying operation portion 205 is formed so that the distance between the walls 251 and 252 of the bass intensifying operation portion 205 is constant along the long direction.

The hollow shape of the main transformation portion 206 is formed to be rectangular in cross section which is the same as that of the bass intensifying operation portion 205. At this time, the distance between walls 261 and 262 of the main transformation portion 206 is set so as to be the same as the distance between the walls 251 and 252 of the bass intensifying operation portion 205 and a constant distance. A wall 263 of the main transformation portion 206 is formed so as to be smoothly continuous with the wall 253 of the bass intensifying operation portion 205. A wall 264 of the main transformation portion 206 is formed so as to be smoothly continuous with the wall 254 of the bass intensifying operation portion 205.

With such a constitution as well, by appropriately setting the hollow cross-sectional area and length of the bass intensifying operation portions 203 and 205 in accordance with the specifications of the bass intensification of the speaker apparatus 3, even without a main tubular portion, it is possible to generate the same action as the action shown in the first embodiment given above, and possible to obtain the same effect.

Note that in the above embodiment, the case was illustrated of the air rectifiers 201, 202 having the same shape, but they do not necessarily need to have the same shape. For example, the length of the one air rectifier 201 in the axial direction may be long, and the length of the other air rectifier 202 in the axial direction may be short. Also, if the length of the air rectifier 201 is sufficiently long to function as a port, in that case, even with only the air rectifier 201 on the port opening side, it is possible to realize the tubular body (bass reflex port) of the present invention.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A speaker apparatus comprising a phase inversion-type enclosure in which a speaker unit and a bass reflex port are installed, the bass reflex port having a tubular body whose hollow cross-sectional area gradually becomes smaller from one opening side toward an inside of the bass reflex port in an axial direction of the bass reflex port, a length in one direction of the hollow cross section of the tubular body being not changing and constant along the axial direction of the bass reflex port, a length in other direction of the hollow cross section of the tubular body being changing along the axial direction of the bass reflex port, and the one direction being perpendicular to both the other direction and to the axial direction of the bass reflex port;

wherein, a predetermined length portion of the tubular body portion along the axial direction of the bass reflex port at a location at which the hollow cross-sectional area is smallest is a main tubular portion in which the hollow cross-sectional area is constant, a portion of the tubular body portion that connects to at least one end of the main tubular portion and in which the hollow cross-sectional area gradually increases from a side that connects to the main tubular portion toward the opening end of the bass reflex port is an air rectifier, the speaker unit is provided at a first end of the enclosure in an axial direction of the enclosure, a first opening portion of the bass reflex port is provided directly under the speaker unit in the axial direction of the bass reflex port, a second opening portion of the bass reflex port is provided at a second end of the enclosure in the axial direction of the enclosure, the first and second ends of the enclosure are opposite to each other with respect to the axial direction of the enclosure, and the second opening portion of the bass reflex port is provided in a direction different from an axial direction of the air rectifier.

2. The speaker apparatus according to claim 1, wherein the tubular body has a shape in which the hollow cross-sectional area gradually increases from a location where the hollow cross-sectional area is smallest toward another bass reflex port opening side in the axial direction of the bass reflex port.

3. The speaker apparatus according to claim 1, wherein the main tubular portion and the air rectifier are arranged so that a center of the hollow cross section of the main tubular portion that is perpendicular to the axial direction of the bass reflex port and a center of the hollow cross section of the air rectifier that is perpendicular to the axial direction of the bass reflex port agree, and walls of connecting portions of the main tubular portion and the air rectifier have a shape that smoothly connects walls of the main tubular portion and walls of the air rectifier.

* * * * *

UNITED STATES PATENT AND TRADEMARK OFFICE

CERTIFICATE OF CORRECTION

PATENT NO. : 8,028,792 B2
APPLICATION NO. : 12/410917
DATED : October 4, 2011
INVENTOR(S) : Akira Arai It is certified that error appears in the above-identified patent and that said Letters Patent is hereby corrected as shown below:

Title Page, Item (30) Foreign Application Priority Data should read

-- Mar. 27, 2008 (JP) ..... 2008-082512 --

Signed and Sealed this
Sixth Day of March, 2012

David J. Kappos

David J. Kappos
*Director of the United States Patent and Trademark Office*